United States Patent [19]

Evans

[11] 4,316,682

[45] Feb. 23, 1982

[54] ORE CARRIER

[75] Inventor: Hugh W. Evans, Denver, Colo.

[73] Assignee: Atlantic Richfield Company, Los Angeles, Calif. ; a part interest

[21] Appl. No.: 189,560

[22] Filed: Sep. 22, 1980

Related U.S. Application Data

[62] Division of Ser. No. 123,876, Feb. 25, 1980, Pat. No. 4,247,229.

[51] Int. Cl.[3] ..... B65G 51/06

[52] U.S. Cl. ..... 406/187; 9/10; 406/190

[58] Field of Search ..... 406/184–190, 406/198; 114/256; 9/10, 8 R

[56] References Cited

U.S. PATENT DOCUMENTS

| | | | |
|---|---|---|---|
| 254,152 | 2/1882 | O'Donnell et al. | 9/10 |
| 393,585 | 11/1888 | Robinson | 406/184 X |
| 1,370,432 | 3/1921 | Gvosdenovich | 9/10 |
| 4,042,190 | 8/1977 | Ueno | 406/190 X |
| 4,184,792 | 1/1980 | Turnbo | 406/186 X |

FOREIGN PATENT DOCUMENTS

| | | | |
|---|---|---|---|
| 52-59481 | 5/1977 | Japan | 406/198 |

*Primary Examiner*—Jeffrey V. Nase
*Attorney, Agent, or Firm*—Roderick W. MacDonald

[57] ABSTRACT

An ore carrier having an ore chamber and a buoyancy chamber and a door at the top and bottom thereof. The doors being rectractable into the buoyancy chamber when the doors are open for either loading or unloading the ore chamber.

4 Claims, 3 Drawing Figures

ORE CARRIER

CROSS REFERENCES TO RELATED APPLICATIONS

This is a division of U.S. application Ser. No. 123,876, filed Feb. 25, 1980, now U.S. Pat. No. 4,247,229.

BACKGROUND OF THE INVENTION

Heretofore in underground mining operations it has been common practice to remove ore from underground in the mine, to force air from the earth's surface into the mine for ventilation and other purposes, to pump encroacing water from the mine shafts to the earth's surface, and the like, by addressing each process individually.

It would be very helpful not only from an operational viewpoint, but also from an energy conservation approach, to deal with these various seemingly independent processes in a coordinated systems-type manner thereby obtaining a maximum coordinated effect from these various processes as they proceed toward their individual goals.

BRIEF DESCRIPTION OF THE INVENTION

In accordance with this invention a systems approach is taken with various mine operation processes so that the mine ore removal process is integrated with the ventilation and mine water removal processes to yield a system which results in a substantial energy savings.

By this invention, there is provided an underground mining method and apparatus which utilizes at least two, first and second, spaced-apart shafts, which can be but are not necessarily, circular drilled shafts, which extend essentially downwardly into the earth and which have at least one lateral opening connecting each other at one or more locations below the earth's surface.

The descending empty ore carrier(s) in the first shaft utilize air compressed by and below the descending carrier in that shaft to control the rate of descent of that carrier. The excess compressed air caused by the descent of the carrier is utilized in the mine ventilation system and/or utilized otherwise for mining requirements such as powering compressed air driven tools.

The empty carrier, once its descent has stopped at a predetermined point at or near a lateral opening is moved horizontally through an airtight door into its loading position in a loading compartment. There the carrier is filled with ore and closed in a watertight manner. The compartment is then filled rapidly with water. Thereafter the carrier is transferred through a second air/watertight door into the second shaft. The second shaft remains flooded with mine water and serves as the means for removing water from the mine to the earth's surface, as well as serving as means for floating the now loaded ore carrier to the earth's surface for unloading. Thus, ore is removed from underground in the mine at the same time as the mine water, and the energy expense of moving the ore upwardly in shaft is in effect eliminated by the carrier's buoyancy.

Accordingly, it is an object of this invention to provide a new and improved method of lifting ore from and dewatering, with some assistance in ventilating, an underground mine. It is another object to provide a new and improved system and ore carrier for carrying out underground mining in a coordinated manner to effect energy conservation in the overall mining scheme.

Other aspects, objects and advantages of this invention will be apparent to those skilled in the art from this disclosure and the appended claims.

DETAILED DESCRIPTION OF THE INVENTION

Figure 1:
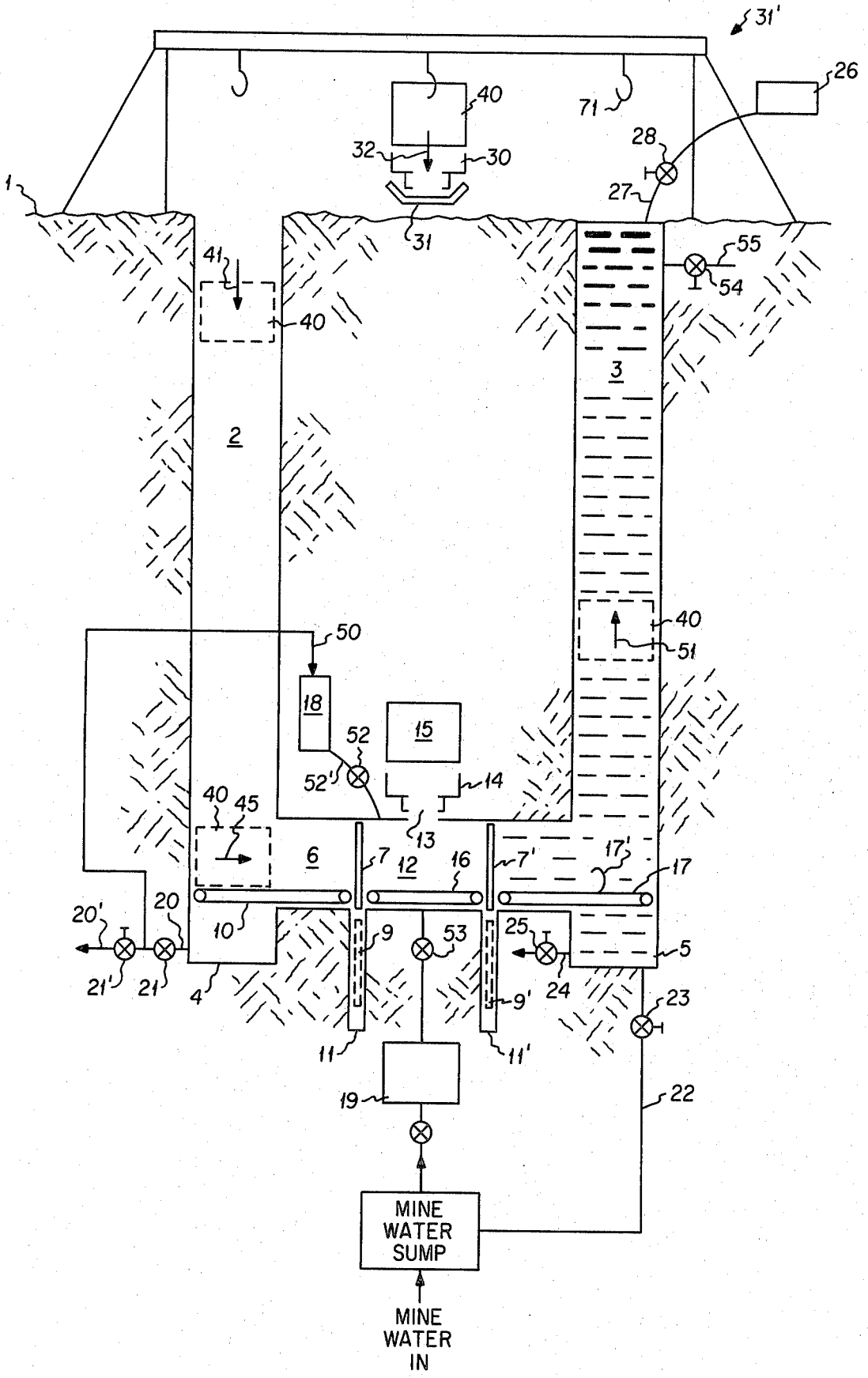
FIG. 1 shows a cross-section of two mine shafts with a lateral opening extending there between and the coordinated system of this invention for ore removal, air injection into the underground mining system, and mine water removal.

More specifically, FIG. 1 shows earth's surface 1 with first and second mine shafts 2 and 3, respectively, penetrating downwardly in the earth a finite distance. Shafts 2 and 3 are joined near their bottom ends 4 and 5 by a lateral opening 6 so that open communication is established between the pair of shafts below the earth's surface. In this invention more than one such lateral opening can be employed in any combination of two or three or more shafts, one lateral opening and two shafts being shown here only for sake of simplicity. In carrier transfer lateral 6 there is a pair of air/water lock doors 7 and 7' which can be opened by withdrawal into slots 11 and 11' as required and as shown by dotted lines 9 and 9' to allow an ore carrier to pass from its stopping place on first conveyor means 10. Doors 7 and 7' fit in slots 11 and 11' in a sliding but still watertight manner by use of conventional gasket means or the like which is well known in the art so that slots 11 and 11' do not leak water around doors 7 and 7' when they are closed individually or together.

Conveyor 10 transports an ore carrier part way into lateral 6 through open door 7 into air/water lock compartment 12 and onto second conveyor 16. Doors 7 and 7', when closed, seal compartment 12 in a watertight and airtight manner for reasons which will be discussed hereinafter.

Compartment 12 has an air/watertight loading gate/chute 13 which communicates with a special preweighed ore carrier pocket 14 which in turn communicates with an ore feeding hopper 15. Hopper 15 receives ore from the mining operation. When the ore carrier in compartment 12 has been filled with the pre-determined quantity of ore from carrier pocket 14, compartment 12 is purged of air through purge valve 52 into air bleed and compress chamber 18, by filling it with water pumped at high speed from rapid fill container 19 through control valve 53. Then door 7' is opened along dotted line 11' and the loaded ore carrier is transferred from conveyor 16 to third conveyor 17 to complete the transfer of the carrier from shaft 2 into shaft 3. Conveyor 17 carries hook means 17' or other suitable hold-down means known in the art so that it holds the ore carrier down until the carrier is in the proper position for release, manual or automatic, to float up shaft 3 to the earth's surface.

Shaft 2 has fixed thereto at its base, air bleeder pipe 20 which carries adjustable throttling valves 21 and 21' for metering the flow of compressed air out of shaft 2 when a carrier is descending into shaft 2 from earth's surface 1. Shaft 3 carries mine water pipe means 22 with another conventional, adjustable, throttling valve 23 for admitting underground mine water pumped under high pressure into shaft 3 to keep shaft 3 full of water as well as to discharge excess mine water. The ore carriers float to earth's surface 1 by their own built-in buoyancy assisted by the normal movement of the mine water to the earth's surface. The bottom area of shaft 3 also carries a pipe means 24 with adjustable throttling valve 25 for draining the interior of shaft 3, pipe 24 being connected to the earth's surface 1 and/or other places in the mine system by other pumps and pipes as desired.

In situations where the mine is dry or there is otherwise a shortage of available water, water tank 26 with associated piping 27 and adjustable valve 28 is employed at the earth's surface to supply water to the interior of shaft 3.

On the earth's surface an ore receiving and storage bin 30 is provided together with conveying means 31 and transfer means 31'. Transfer means 31' is shown in this embodiment to be a crane which receives loaded ore carriers from shaft 3, transmits the carriers over bin 30 for rapid dumping of ore contained therein as shown by arrow 32, and then further transports the empty carriers to and release the carriers into shaft 2. The ore carrier is specially designed, based on the ore being mined, for rapid loading and discharge with suitable doors on both the top and bottom of the carrier and with suitable buoyancy means to give a pre-determined rate of ascent of the loaded carrier in shaft 3. A conveyor means 31 is utilized to transfer the ore from the bottom of receiving hopper 30 to the ore processing facilities (not shown) in a conventional manner.

In operation, an ore carrier 40 is shown in its initial position at the earth's surface having its ore content removed into bin 30. After carrier 40 is emptied, it is transported by way of crane 31' over the opening in the earth's surface formed by shaft 2 and released into shaft 2 for descent into that shaft as shown by arrow 41. The rate of descent of empty ore carrier 40 will be controlled by metering the outflow of compressed air through valves 21 and 21' and pipe 20. Door 7 is closed and sealed in an airtight manner during the descent of carrier 40 in shaft 2 so that the carrier's rate of descent is controlled essentially only by metering of compressed air through valve 21. Valve 21 can be controlled by electrical means from the earth's surface using equipment and techniques well known in the art. The outgoing air in pipe 20 can be channeled elsewhere in the mine system to be used as ventilation air, compressed air for operating tools, and the like by way of pipe means 20' and/or to air chamber 18 by way of pipe means 50. Thus, it can be seen that the energy generated by one or more descending ore carriers 40 is converted in part into useful compressed air for other mining operations.

Carrier 40 stops on conveyor 10 which is cushioned for impact in a conventional manner well known in the art. Carrier 40 can then be transferred from shaft 2 into opening 6, as shown by arrow 45, through open door 7, onto conveyor 16, and into its loading position in compartment 12 under the opening of ore chute 13. Door 7 is then closed in a sealed manner after the carrier passes so that the next carrier can be dropped down shaft 2. Door 7' was closed and compartment 12 drained of water before door 7 was opened. Then, ore is transferred from carrier load hopper 14 through chute 13 into the interior of carrier 40. After the predetermined amount of ore has been deposited in carrier 40, the carrier is closed in a watertight manner. Then compartment 12 is filled, preferably by high speed pumps, with water from water fill and discharge container 19 through control valve 53. As the water fills compartment 12 the air therein is bled off through pipe means 52' and control valve 52 into air chamber 18. When compartment 12 is full of water, door 7' is opened by sliding into slot 11' and carrier 40 moves by means of conveyors 16 and 17 to the bottom of shaft 3.

The closed ore-bearing carrier then floats upwardly as shown by arrow 51 to the earth's surface. There it is picked up by transfer means 31' and transferred over bin 30 for dumping of its ore content. As soon as carrier 40 passes, door 7' is closed and sealed again, and the water in compartment 12 is rapidly drained through control valve 53 into container 19. Air is forced in through pipe 52' and valve 52 as the water drains. Thus, compartment 12 is ready to receive the next carrier as described above. Mine water is pumped into container 19 for makeup as necessary or into the bottom of shaft 3 through valve 23 and pipe means 22 to remove the water from the mine. Surplus mine water can be decanted off the top of shaft 3 through valve 54 and pipe means 55. Thereafter the sequence of steps just described is repeated.

In all some six or more ore carriers, depending on the shaft depth and carrier design, could be kept in operation at the same time, e.g., one discharging ore at the earth's surface, one being dropped or held at the bottom of shaft 2, one being loaded in compartment 12, and three or more floating to the surface in shaft 3 depending again on the shaft depth and also on the amount of buoyancy designed into the ore carriers.

It can be seen that substantial energy savings are achieved by utilizing compressed air to control the descent of empty carrier 40 in shaft 2 and by its own buoyancy in mine water to raise loaded carrier 40 in shaft 3 to the earth's surface. This is especially true if the underground mine water must be moved to the earth's surface anyway. Put another way, the energy naturally generated by the descent of carrier 40 in shaft 2 is transferred in part to usefully compressed air for use elsewhere, and mine water which would otherwise have to be pumped to the earth's surface anyway is utilized to float ore to the surface. This overall integrated system thus coordinates these various processes for maximum efficiency and energy conservation.

The system of this invention can be employed in any underground mining system whether coal, copper, oil shale, or the like. The size and depth of shafts 2 and 3 and opening 6 together with the sizing and adjustment of various piping and valves disclosed in this invention will vary widely depending upon the particular mine system and the ore being mined, but are well within the scope of one skilled in the art to determine once the inventive concept of this invention is known. Accordingly, further detailed description of these matters, which are well within the skill of the art to determine for each special situation, are not necessary to inform the art further.

Figure 2:
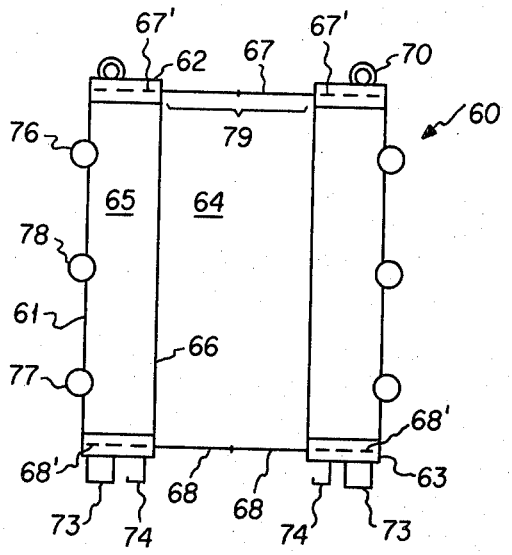
FIGS. 2 and 3 show an ore carrier useful in the practice of the method of this invention.

FIG. 2 shows a side view of an ore carrier 60 which is a closed hollow body composed of upstanding side means 61 with closed top means 62 and bottom means 63. The interior of the bottom 63 is divided into a hollow ore chamber 64 which extends from top 62 to bottom 63. The remainder of the interior of the body of carrier 60 is composed of at least one buoyancy chamber such as annular, concentric chamber 65. Chamber 65 can be hollow and airtight or contain buoyancy material as desired. Chambers 64 and 65 are physically separated from one another by interior wall 66.

The top of chamber 64 is closed by a pair of sliding doors 67 which, when open, retract into buoyancy chamber 65 as shown by dotted lines 67'. Similarly, the bottom of ore chamber 64 is closed by another pair of sliding doors 68 which also when open retract into buoyancy chamber 65 as shown by dotted line 68'.

Top 62 carries a plurality of lift eyes 70 for engaging hooks or lifting devices 71 of transfer means 31' of FIG. 1. When hooks 71 engage eyes 70, carrier 40 of FIG. 1 is then lifted and transferred over the top of ore receive 30 for unloading of carrier 40.

Bottom 63 carries at least one fall cushioning means 73 which can be solid rubber, inflated rubber, or any other desired and well known cushioning means such as metal springs and the like which are designed to absorb a substantial amount of the impact resulting when carrier 40 descending in shaft 1 of FIG. 1 comes to rest on conveyor means 10. Bottom 63 also carries a plurality of hold-down means 74 which are adapted to hook onto conveyor means 17 and hold the ore carrier to the conveyor even though it is buoyant in flooded shaft 3 until the carrier is positioned at the bottom of shaft 3 for release to float to the earth's surface. The cushioning means 73 and hold down means 74 are devices well known in the art and commercially available and, therefore, further description is not necessary to inform the art.

Side means 61 carries two sets of resilient O-rings 76, 77, and 78 which are designed to sealably engage the walls of shaft 2, and preferably although not necessarily, shaft 3 as well, to provide a seal means between side 61 and the walls of the shaft. This is helpful in controlling the descent of ore carrier 40 in shaft 2 as described hereinabove.

Doors 67 and 68 of ore chamber 64 can be any desired type or configuration of door, the pairs of sliding doors shown in FIG. 2 being for description sake only.

Figure 3:
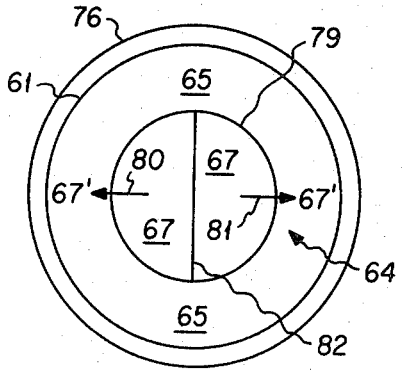

FIG. 3 shows a top view of the ore carrier of FIG. 2 showing the carrier to be of generally circular configuration, although the external configuration of the carrier of this invention is not necessarily limited to such a configuration, the prime requirement being that the outside configuration of the carrier be adapted to meet the internal configuration of the shaft through which it is to be transported. Thus, it can be seen that the circular ore carrier has an inside circular ore chamber 64 which extends from top to bottom of carrier 60 and also is circular with its diameter designed to give the outer lying buoyancy chamber 65, or plurality of chambers if chamber 65 is to have bulkheads, suitable buoyancy to realize the lift speed desired in shaft 3. The top of chamber 64 is circular in configuration as well and shows the pair of opposing, sliding doors 67 which close the top opening 79 when they meet along line 82 and which slide apart in the direction of arrows 80 and 81 to open opening 79 by retracting into ore chamber 64 or even beyond the outer periphery of side means 61, if necessary, to fully open opening 78 and thereby prevent ore hangups. Door 67 can have a tongue-in-groove mating arrangement along door closing line 82, and can carry opening ears designed for top shaft and bottom shaft pull-push devices for opening and closing doors 67 under hopper 15 and over hopper 30, respectively. This invention is not necessarily limited to a single circular ore chamber in a given carrier just as it is not limited to a single circular or multiple noncircular buoyancy chambers, the carrier of this invention being adapted to one or more ore chambers as well as one or more buoyancy chambers as those skilled in the art desire once the concept of this invention is made known to them.

Reasonable variations and modifications are possible within the scope of this disclosure without departing from the spirit and scope of this invention.

The embodiments of the invention in which an exclusive property or privilege is claimed are defined as follows:

1. An ore carrier comprising a closed, hollow body having side, top, and bottom means, said body being configured to pass through one or more underground shafts, said body containing interiorally thereof at least one ore chamber and at least one buoyancy chamber, said ore chamber extending from said top means to said bottom means, watertight door means in said top means and said bottom means for top loading of said carrier and bottom unloading of said carrier, said door means retracting into said buoyancy chamber when said door means are open for loading or unloading.

2. An ore carrier according to claim 1 wherein said carrier has on its bottom means at least one fall-cushioning means.

3. An ore carrier according to claim 1 wherein said carrier has on its bottom means at least one hold-down means for holding said carrier on a conveying means.

4. An ore carrier according to claim 1 wherein said carrier has on its side means at least one seal means for suitable sealing engagement with the sides of a shaft through which said carrier is being transported.

* * * * *